US005320895A

United States Patent [19]

Larsonneur et al.

[11] Patent Number: 5,320,895

[45] Date of Patent: Jun. 14, 1994

[54] PERFORATED ABSORBENT PAD WITH TUFTS OF TISSUE PROJECTING FROM THE UNDERSIDE

[75] Inventors: Lionel M. Larsonneur, Pomona; Stanley E. Schilcher, Trabuco Canyon, both of Calif.

[73] Assignee: Paper-Pak Products, Inc., La Verne, Calif.

[21] Appl. No.: 27,024

[22] Filed: Mar. 5, 1993

[51] Int. Cl.[5] ..... B32B 3/10; B65D 81/26

[52] U.S. Cl. ..... 428/137; 428/74; 428/76; 428/132; 428/138; 428/507; 428/508; 428/509; 428/323; 428/195; 428/913; 206/204; 426/124; 426/129

[58] Field of Search ..... 428/137, 74, 76, 132, 428/138, 507, 508, 509, 323, 195, 913; 206/204; 426/124, 129

[56] References Cited

U.S. PATENT DOCUMENTS

| | | | |
|---|---|---|---|
| 4,275,811 | 6/1981 | Miller | 206/204 |
| 4,321,997 | 3/1982 | Miller | 206/204 |
| 4,382,507 | 5/1983 | Miller | 206/204 |
| 4,410,578 | 10/1983 | Miller | 428/117 |
| 4,614,679 | 9/1986 | Farrington, Jr. et al. | 428/137 |
| 4,735,846 | 5/1988 | Larsonneur | 428/198 |
| 4,756,939 | 7/1988 | Goodwin | 206/204 |
| 4,770,920 | 8/1988 | Larsonneur | 428/198 |
| 4,935,282 | 6/1990 | Pawlowski et al. | 428/136 |
| 4,940,621 | 7/1990 | Rhodes et al. | 428/137 |
| 5,022,945 | 6/1991 | Rhodes et al. | 156/253 |
| 5,055,332 | 10/1991 | Rhodes et al. | 428/74 |
| 5,151,315 | 9/1992 | Ponnet | 428/137 |
| 5,180,620 | 1/1993 | Mende | 428/138 |

*Primary Examiner*—William Watkins, III

*Attorney, Agent, or Firm*—Henry M. Bissell

[57] ABSTRACT

An absorbent pad for use with meat and poultry products in retail sale packages has a laminated tissue absorbent mat sandwiched and sealed between upper and lower plastic sheets. The pad is perforated by penetration of perforating pins entirely through the pad to develop a series of holes for the passage of liquid from the meat package into the absorbent mat inside the pad. A myriad of outwardly projecting tufts of tissue material are developed along the underside of the pad by the perforating pins. These tufts develop a wicking effect which enhances the capillary action of the tissue layers inside the pad. Methods of fabrication of the individual pads and continuous linear absorbent sheet material are also disclosed.

20 Claims, 4 Drawing Sheets

PERFORATED ABSORBENT PAD WITH TUFTS OF TISSUE PROJECTING FROM THE UNDERSIDE

BACKGROUND OF THE INVENTION

1. Field of the Invention

This invention relates to absorbent pads and, more particularly, to such pads which are used in packaging of meat products for absorbing liquids leaking therefrom and to the method of fabricating such pads.

2. Description of the Related Art

Absorbent pads particularly designed for packaging with meats, poultry and fish food products are used in food markets, poultry processing plants and the like to reduce product display costs and to provide a cleaner, more attractive product. These pads are generally wrapped with the food product on the underside thereof to absorb liquids which may "bleed" from the product. In poultry products, for example, it is customary to place the poultry parts of a given package in a molded shallow tray of foamed plastic or the like. One of these absorbent pads is placed in the bottom of the tray and the poultry parts are placed thereon. The complete package is then wrapped with clear polyethylene or the like. U.S. Pat. Nos. 4,735,846 and 4,770,920 of Lionel M. Larsonneur, one of the inventors herein, disclose one such pad which is constructed of layers of highly absorbent cellulose tissue plus at least a polyethylene backing layer. The layers are bonded together by a plurality of pressure bonds and protected against delamination by the application of melted wax or the like to the areas surrounding the individual pressure bonded spots.

U.S. Pat. Nos. 4,275,811, 4,321,997, 4,382,507 and 4,410,578 of Alan H. Miller disclose receptacles for containing and displaying food products which tend to exude juices or liquids, which receptacle comprises a tray or bag and an absorbent pad associated therewith. The disclosed pad comprises a mat of liquid absorbent material, an upper liquid impermeable sheet overlying the absorbent mat, and a perforated bottom sheet underlying the absorbent mat. When a food product is positioned upon the upper sheet of the absorbent pad, any exuded liquids flow around the pad and enter the mat by capillary action through perforated openings of the bottom sheet.

Another set of patents of John C. Rhodes et al, U.S. Pat. Nos. 4,940,621, 5,022,945 and 5,055,332, discloses an absorbent pad for meat and poultry products. The disclosed pad includes upper and lower plastic film layers, at least one of which is perforated, and an intermediate absorbent layer disposed between the film layers. The intermediate absorbent layer includes a series of juxtaposed and overlapping material fibers with superabsorbent granules dispersed throughout the absorbent layer and supported by the absorbent material fibers within interstices thereof. The absorbent pads of Rhodes et al function substantially like the pads of the Miller patents listed above.

All of the poultry/meat pads which are known comprise a liquid absorbent mat or laminated tissue pad within a plastic envelope or supported on a plastic layer which is perforated or otherwise rendered permeable to liquid. The liquid must pass through the plastic layer in order to reach the absorbent mat or pad contained therein. Once past the plastic layer, the liquid spreads throughout the absorbent pad by capillary action. However, there are circumstances where the liquid does not readily pass through openings in the plastic layer, in which case it is not absorbed, such as, for example, when meat packages are "shingled", i.e., stacked on edge or in a canted display. What is needed is an improved arrangement in which the effectiveness of the capillary action within the absorbent pads in the interior of the plastic envelopes can be enhanced and extended to reach liquid outside the envelope

SUMMARY OF THE INVENTION

In brief, arrangements in accordance with the present invention include an absorbent pad in the form of a plurality of laminated tissue layers mounted inside a plastic envelope. The plastic is perforated by inserting a plurality of pins from the upper side entirely through the pad so that a series of tufts of absorbent tissue protrude from the underside of the pad. The pad is marked in some fashion, such as by placing the notation "THIS SIDE UP" on the side into which the pins are inserted, so that in use as intended the tufted side is exposed to the liquid which bleeds from the meat, poultry or fish into the tray or other container. These individual tufts, although minuscule in scale, extend the absorbent material through the holes in the underside plastic layer, thereby materially enhancing the effectiveness of the absorbent pad capillary action for the liquid with which they come in contact. The tufts act as individual wicks (absorptive protuberances) which reach outwardly from the absorbent mats within the plastic envelopes through the holes in the plastic layer on the underside of the pad to make contact with liquid that might not otherwise reach the interior absorbent mat.

Particular arrangements in accordance with the invention may be in the form of individual pads of the type described or may be in the form of a continuous roll of absorbent laminated layer sheet material comprising the constituent elements of pads as described above which can be readily severable into individual pads at the point where the pad, tray and wrapping are assembled with an individual meat or poultry product. Such continuous laminated material can also serve as a shelf liner for meat display cases and the like.

In accordance with one method of the invention, the pad is fabricated by drawing a plurality of tissue layers from corresponding rolls and forming them into a continuous lamination. For continuous display case shelf liners and the like, this is introduced between an upper and a lower layer of plastic, drawn from corresponding plastic rolls, which are adhered together along the side edges by spraying or otherwise applying glue or other adhesive on the surfaces adjacent the edges. Heat sealing is also possible for adhering the peripheral edges together.

For the fabrication of individual pads, the laminated tissue layer is slit lengthwise and cut crosswise to form individual pads of laminated tissue layers of the size desired. These are then conveyed to a point for insertion between upper and lower layers of plastic which are drawn from corresponding plastic layer rolls. Adhesive is applied to one or both of the plastic layers in the region extending about the periphery of an individual pad, after which pressure is applied to seal the plastic layers in the peripheral regions of the finished pad.

After the pads have been formed by encasing the individual absorbent mats within the plastic envelopes or after the continuous plastic-sheathed laminate is formed, as the case may be, the complete assembly is run over a pin drum which presses the assembly against a rubber roll. The pins on the pin drum penetrate the plastic layer and mat laminate assembly, entering at the top side and extending out the underside, thus developing the tufts of absorbent material which are pushed outward through the underside plastic layer from the absorbent laminated mat within the plastic envelope.

After the pad assembly passes the pin drum, the now-perforated and tufted assembly is slit lengthwise and cut crosswise to form the individual meat/poultry pads.

BRIEF DESCRIPTION OF THE DRAWING

A better understanding of the present invention may be realized from a consideration of the following detailed description, taken in conjunction with the accompanying drawing, in which.

PRIOR ART

Figure 1:
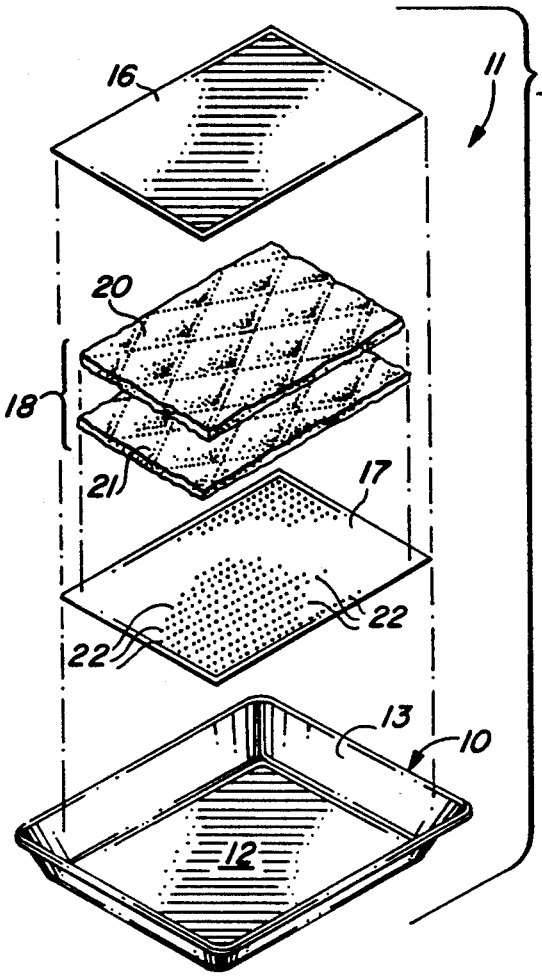
FIG. 1 is an exploded view showing a poultry pad of the prior art which is similar to the present invention.
Figure 2:
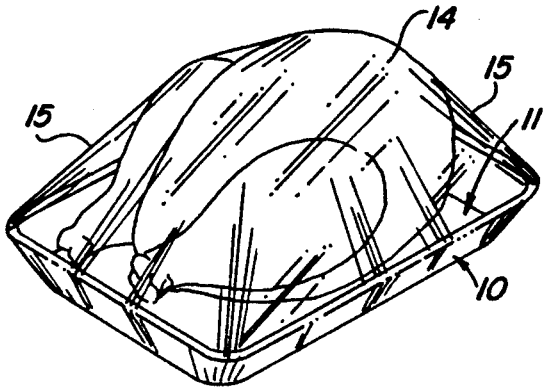
FIG. 2 is a view indicating the use of absorbent pads of the present invention in association with a poultry product.

FIG. 1 represents an exploded view of a commonly available absorbent pad and indicates the way in which it is used as a display receptacle. Support tray 10 is shown positioned to receive absorbent pad 11. The support tray 10 may conveniently be fabricated from a relatively rigid, molded foam, plastic material and has a generally rectangular bottom wall 12 and upstanding peripheral walls 13. The pad 11 is also rectangular, and is sized to overlap substantially the full area of the bottom wall 12 of the tray 10. In use, the pad 11 is positioned upon the bottom 12 and a food product, such as the fowl 14 (see FIG. 2), is positioned to rest upon the pad. As shown in FIG. 2, an outer wrapping of suitable thermoplastic film material 15 may be positioned over the fowl 14 and heat sealed or otherwise closed beneath the tray 10 in conventional fashion, forming a completed food package.

The pad 11 is formed of an upper sheet 16 and a lower sheet 17 of substantially liquid impermeable hydrophobic material which are edge sealed to form an envelope enclosing a double-layered absorbent mat 18. The mat 18 comprises a thick upper layer 20 of wood fluff and a thin under-layer 21 of tissue-like paper wadding. The bottom sheet 17 is perforated generally uniformly with minute openings, indicated at 22 and better shown in FIGS. 3 and 4.

Figure 4:
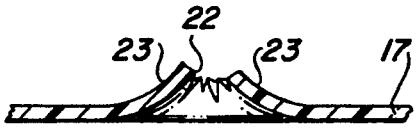
FIG. 4 (PRIOR ART)
FIG. 4 is a sectional view of part of FIG. 3.
Figure 3:
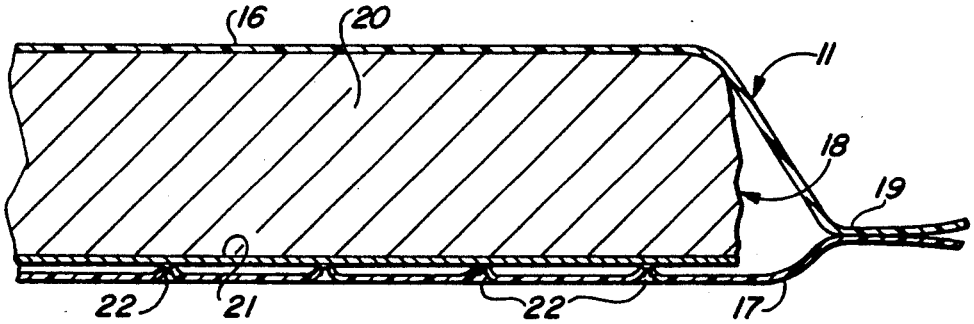
FIG. 3 (PRIOR ART)
FIG. 3 is an enlarged sectional view of a portion of the prior art absorbent pad.

As indicated in FIG. 3, which is a cross-sectional view of an edge portion of the pad 11 of FIG. 1, the openings 22 are distributed substantially uniformly over the full area of the bottom sheet 17. According to U.S. Pat. No. 4,382,507, from which FIGS. 3 and 4 are taken, the openings 22 are distributed substantially uniformly over the full area of the bottom sheet 17 and typically have a density of between about 15 and 100 per square inch. The openings 22 may be formed by a perforating operation, such as by contacting of sheet 17 with a roller covered with pins having a diameter of about 0.01 inches and of the type used on a textile carding cloth. Such a perforating operation results in the openings having a diameter of about 0.01 inches and peripheral portions 23 which extend upwardly from the plane of the sheet 17.

According to U.S. Pat. No. 4,382,507, juices or liquids from the food products resting on the pad 11 will tend to flow downwardly onto the bottom wall 12 of the tray 10 and beneath the pad, such that capillary action of absorbent material in the mat 18 tends to lift these liquids into the pad where they are held out of contact with the food product. It has been found in practice, however, that the capillary action demonstrated by the absorbent material in the mat 18 is somewhat inhibited by the structural configuration of the pad 11. At each opening 22, the material 23 surrounding the opening is lifted upwardly from the plane of the bottom sheet 17. As indicated in FIG. 3, this displaces the bottom absorbent layer 21 inwardly from the plane of the sheet 17. Furthermore, the small size of the openings 22 develops a certain hydrostatic resistance to liquid which the pad 11 is designed to absorb through the bottom openings. Thus, a certain threshold hydrostatic pressure in the liquid along the underside of the pad 11 is required before it can reach the absorbent layer 21 where the capillary action can begin to be effective in absorbing the liquid from the associated meat product. What is needed is some structural configuration in which the absorbent material of the pad is not displaced from the outer surface of the bottom sheet 17 so that the normal capillary action is not inhibited by the structural configuration of the pad but may even be enhanced thereby.

DETAILED DESCRIPTION OF THE PREFERRED EMBODIMENTS

Figure 5:
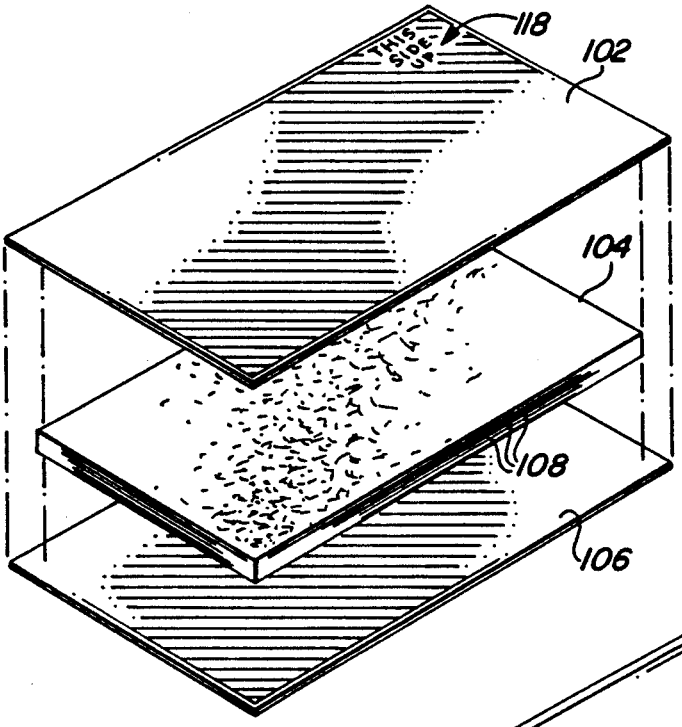
FIG. 5 is an exploded view of an absorbent pad of the present invention.
Figure 6:
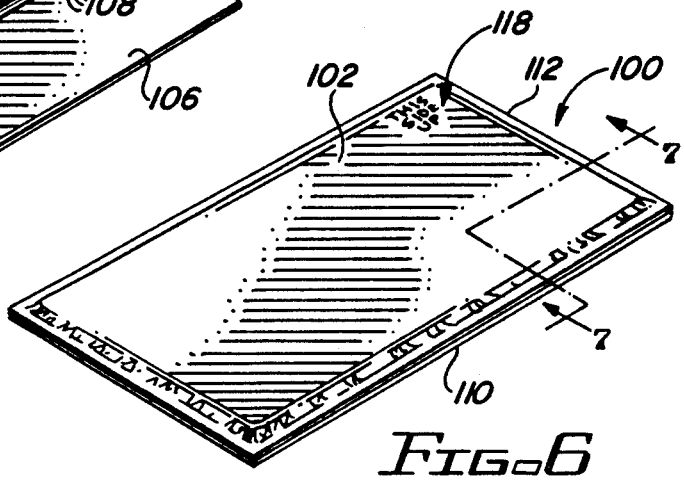
FIG. 6 is a perspective view of the pad of the present invention.

FIGS. 5 and 6 are schematic representations of an absorbent pad 100 in accordance with the present invention. As seen in the exploded view of FIG. 5, the pad 100 comprises an upper sheet 102, an intermediate absorbent mat 104, and a bottom sheet 106. The mat 104 is preferably constructed of a plurality of individual tissue layers 108. The number of layers 108 may be in the range of from 8 to 20, preferably approximately 16 layers. The layers 108 are produced on a Fourdrinier paper making machine and may be creped for extra absorbency. Each layer is similar to household facial tissue in consistency and thickness. As an alternative, the mat 104 may comprise wood fluff or pulp, but this material is not as effective in forming the absorbent tufts that are needed to extend through the bottom sheet after perforation.

In the finished pad 100, the side and end edges 110, 112 of the pad 100 are sealed so that the absorbent tissue mat 104 is completely enclosed in a flexible plastic envelope. The top and bottom sheets 102, 106 are preferably fabricated of polyethylene, although other thin plastic materials may be suitable. The upper and lower sheets 102, 106 are generally impermeable to liquids, although this is not an essential characteristic of the material, considering the way in which the finished pad is fabricated, as will be described hereinbelow. At least one of the sheets 102, 106 is inscribed with graphical indicia to indicate the proper orientation of the pad 100 within a meat or poultry tray, such as the tray 10 of FIG. 1. If imprinted on the upper sheet 102, the indicia comprises the words "THIS SIDE UP" or a message to that effect, indicating that the pad 100 is to be positioned in the meat tray with the sheet 102 on the upper side, remote from the bottom of the tray. If placed on the lower sheet 106, the indicia would indicate the opposite; i.e., "THIS SIDE DOWN", or words to that effect. Such an instructional message would be imprinted on the underside of the sheet 106 which would be visible only if the pad 100 were upside down.

Figure 7:
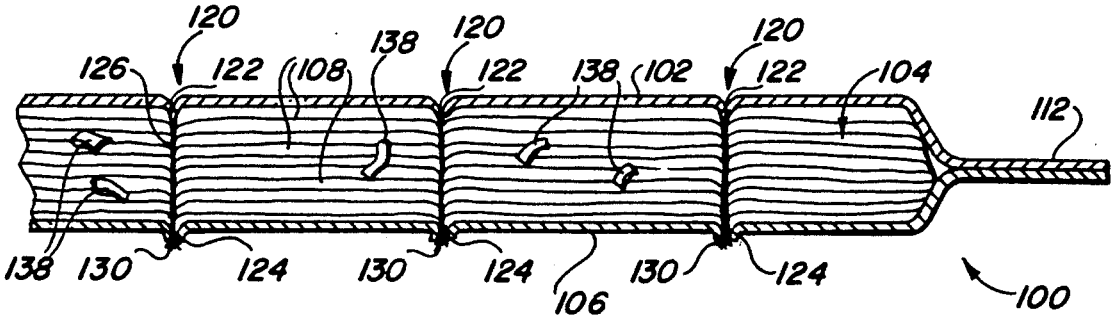
FIG. 7 is an enlarged sectional view of a portion of the pad of FIG. 6.

In the sectional view of FIG. 7, taken along the line 7—7 of FIG. 6 looking in the direction of the arrows, the upper sheet 102, lower sheet 106 and absorbent mat 104 are shown in a laminated sandwich configuration with the sheets 102, 106 being sealed at the edge 112. This sealing may be effected by any suitable adhesive, such as hot melt adhesive, for example. Heat sealing by the application of heat and pressure may also be used.

The pad 100 is provided with a plurality of holes or perforations 120 which extend completely through the pad 100. Thus at each perforation 120, there is an inwardly directed opening 122 in the upper sheet 102 and an outwardly directed opening 124 in the bottom sheet 106. (By "directed" is meant the direction of displacement of that portion of the plastic sheet immediately surrounding the opening relative to the plane of the sheet.) Between the openings 122 and 124 is a passage 126 which extends completely through the absorbent mat 104 with each of the individual layers 108 being pierced to form the passage 126. At the passage 126, each individual layer 108 has a minute severed edge structure which develops a somewhat increased absorbency of the tissue layer at that circumferential edge. The combined effect of all of these pierced tissue edges is an enhanced overall absorbency of the mat 104.

Figure 7A:
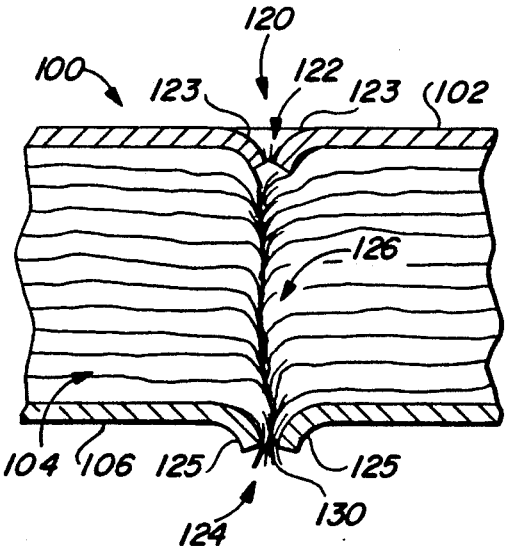
FIG. 7A is a further enlarged view of part of FIG. 7.

Additionally, there is a tuft of tissue material 130 from the absorbent tissue mat 104 projecting outwardly through each of the openings 124 in the lower sheet 106. This structural configuration of the pad 100 is achieved by running the pad 100 between a pin drum and a resilient backing drum of sponge material, rubber or the like so that the pins penetrate entirely through the pad 100. In penetrating the pad 100, the pins create the top and bottom openings 122, 124 and the internal passage 126, at the same time forcing material from the absorbent mat 104 outwardly through the lower openings 124 to form the tissue tufts 130. As the pins are withdrawn from the pad 100, the tufts 130 are left projecting outwardly through the lower openings 124 as indicated in FIGS. 7 and 7A, being retained by the edges 125 of the openings 124. At the same time, the presence of the tufts 130 within the openings 124 serves to keep the edges 125 of the openings 124 in their spread configuration as best shown in FIG. 7A. The tufts 130 inhibit the tendency of the edges 125 of the openings 124 to close due to the elasticity of the material, thereby further enhancing the effectiveness of the pad in absorbing liquids bleeding from the meat or fowl with which it is packed. This feature is to be distinguished from the prior art pads illustrated in FIGS. 3 and 4 wherein the pressure of the absorbent mats 16 bearing against the inwardly directed edges 25 of the openings 24 tends to close up the holes.

As an optional variant for the structure of the absorbent pad or continuous laminate shelf liner of the present invention, supersorbent material may be interspersed throughout the interior tissue laminate. During the fabrication of the pads or shelf liners, the supersorbent material may be dusted in between the tissue layers as a powder or as granular particles. Such superabsorbent granular particles 138 are indicated schematically in FIG. 7. In absorbing liquid, superabsorbent granular particles expand and reform to a gel. This gel absorbs a substantially greater volume of liquid than the capacity of a corresponding volume of cellulose tissue.

As a further optional alternative, the lower sheet 106 may comprise wet-strength tissue instead of impermeable polyethylene. This would achieve somewhat greater absorbency, by virtue of liquids being absorbed into the lower sheet layer itself, than in the case of a pad having a bottom sheet of plastic.

The structural configuration of absorbent pads in accordance with the present invention provides a decided benefit and improved effectiveness in the absorptive properties of such pads, relative to those similar prior art products which are known, by virtue of the protruding tufts (absorptive protuberances 130) which extend the interior absorbent tissue material 104 to the outside of the pad 100, the channels 126 extending along the paths of the pins through the mat of layered tissue inside the pads, and the fixed open position of the openings 124 formed by piercing and stretching the plastic material of the lower sheet 106 which are maintained in the open position by the presence of the tufts 130 projecting therethrough.

The openings 122 in the upper layer 102 also provide a further mechanism by which moisture from a meat or poultry product stacked thereon may be absorbed into the layered tissue mat 104. Contrary to the condition of the openings 124 in the lower sheet 106, the openings 122, while readily transmitting liquid to the tissue mat 104 inside the pad 100, demonstrate a tendency to inhibit the reverse flow of liquid out of the tissue mat 104, at least at the point when the upper tissue layers 108 become soaked. In that condition, the tissues become less absorptive and less resilient and expand somewhat, so that the compressive forces between the upper sheet 102 and the upper layers 108 of the tissue mat 104 serve to at least partially close the openings 122, thereby limiting liquid flow out of the pad. Thus, unlike prior art pads which include a liquid impermeable upper sheet which sometimes permits meat juices to pool in depressions in the pad immediately beneath the meat product, pads of the present invention permit such trapped fluid to seep through the upper sheet, even if the openings 122 are almost closed to substantially inhibit flow in the reverse direction therethrough. These openings do not draw juices out of the meat product, however, because of their minute dimensions and the displacement of the absorbent tissue from the outer surface of the pad.

Figure 8:
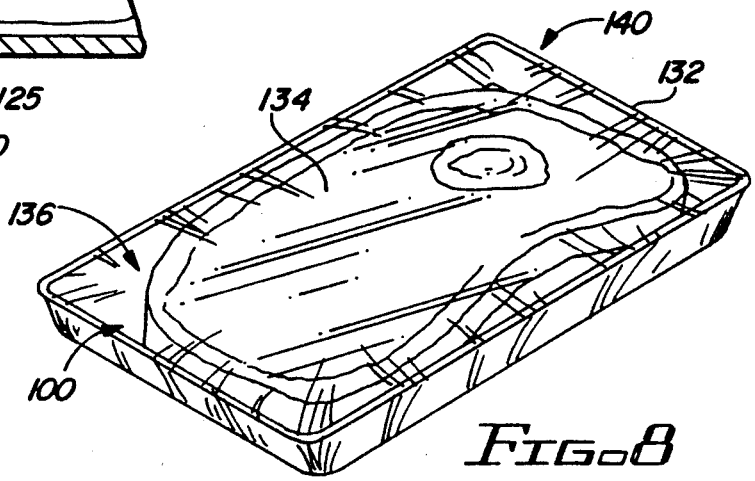
FIG. 8 shows the use of absorbent pads in accordance with the present invention in conjunction with a cut of meat packed for retail sale.
Figure 9:
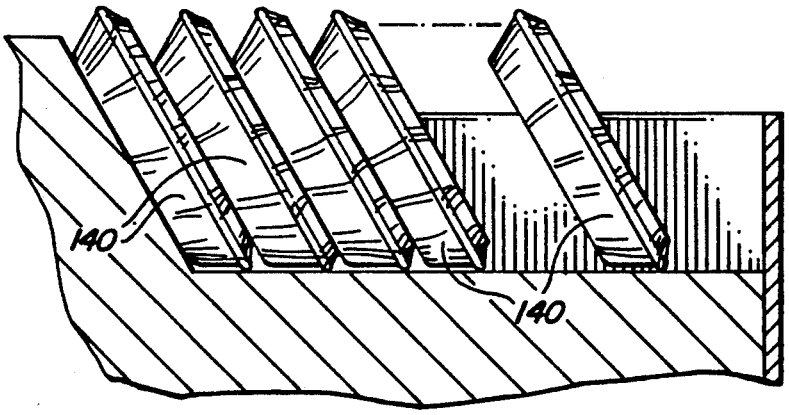
FIG. 9 illustrates a plurality of the packages of FIG. 8 stacked in "shingle" formation.

The enhanced effectiveness of absorptive pads 100 of the structural configuration indicated in FIG. 7 is particularly apparent in the stacking or "shingling" of meat products as shown in FIG. 9. FIG. 8 schematically represents one of these meat packages 140 with an absorbent pad 100 installed along the bottom of a meat package tray 132, between a steak or other cut of meat 134 and the bottom of the tray 132, and wrapped with a suitable transparent plastic wrapping material 136. "Shingling" a plurality of these meat packages 140 in the manner illustrated in FIG. 9 reduces the effectiveness of those prior art absorbent meat pads which are known. Pads in accordance with the present invention, on the other hand, absorb liquid on both sides of the pad, but also draw liquid from the outside of the pad by the wicking action of the absorptive protuberances 130 on the underside. This absorption of such liquid from the protruding tufts of tissue material and transmission on into the tissue mat 104 within the pad 100 occurs as soon as there is any contact between the protruding tufts and the liquid, and without the necessity of some positive hydrostatic pressure to force liquid through the openings, as is the case in the known prior art pads.

It will be understood that the novel features of the present invention are adaptable to continuous linear shelf liner material as well as to the absorbent pads described hereinabove which may be pre-cut in various sizes to fit different size trays and different size cuts of meat or packages of poultry or fish, such as nominally 5×7 inches, 6×9 inches, etc. The fabrication of such continuous linear sheet material is illustrated schematically in FIG. 10. This shows a plurality of rolls 142, each carrying a single layer of cellulose tissue 108 for the tissue mat 104 of the pad 100 as shown in FIG. 7. Each layer of tissue 108 is drawn from its corresponding roll 142 over a corresponding idler roll 144 and then, with the other layers 108, between a pair of rolls 146 which may serve to draw the individual lamination layers 108 along the production line. More rolls 142 and idler rolls 144 may be provided where it is desired to have more than 8 tissue layers 108 in the tissue mat of the absorbent pad or shelf liner.

Figure 10:
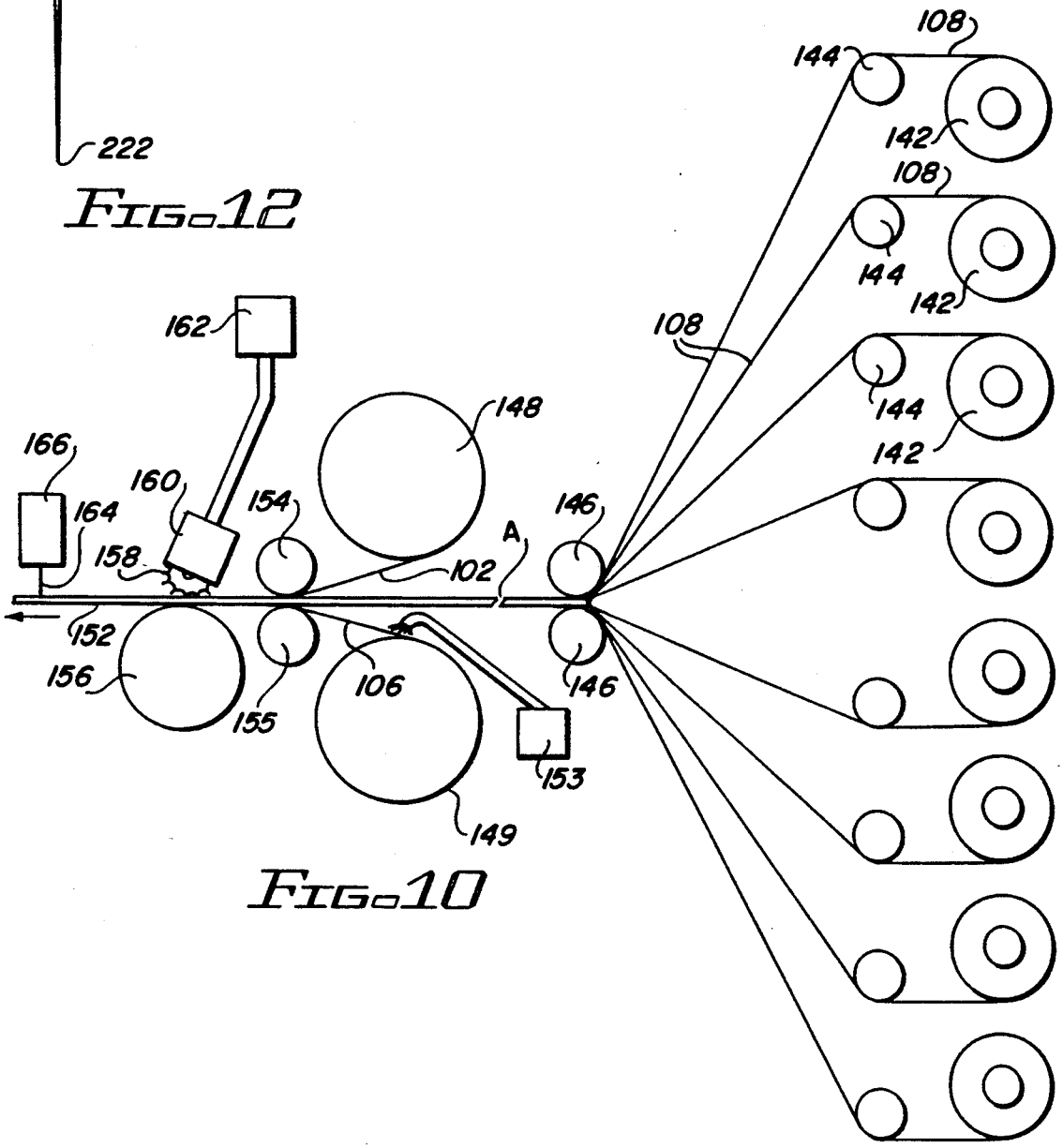
FIG. 10 is a schematic view representing the fabrication of extended lengths of absorbent paper in accordance with the present invention for use as display case shelf liners or for bulk shipment.

When all the layers of cellulose tissue are in place and moving along the conveyor line, as indicated in FIG. 10, the upper sheet 102 is drawn from a roll of thin plastic sheet material 148 and is pressed into position adjacent the laminated tissue layers 108 by a roller 154. Similarly, a bottom layer 106 of plastic (or wet-strength tissue, if desired) is drawn from a roll 149 and fed around a pressing roller 155 opposite the roller 154. Prior to the sheet 106 being brought to the position of the rollers 154, 155, adhesive is applied along the side edges of the continuous linear material 152 by means of an adhesive applying station 153 which serves to spray the side edges of the sheet 106. The rollers 154, 155 serve to press the side edges together, thereby sealing the tissue layers 108 within the continuous linear strip of absorbent material.

Figure 13:
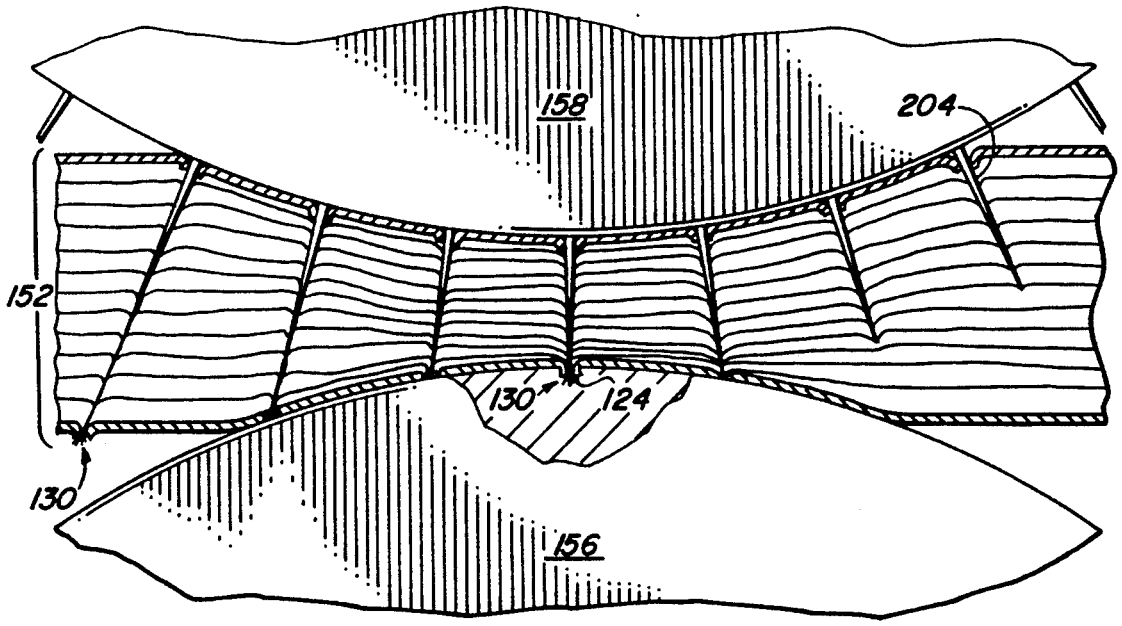
FIG. 13 is an enlarged schematic view of the pin drum perforating a pad against the backing drum of FIGS. 10 and 11.

The thus-formed strip of laminated sheet material passes from rollers 154, 155 to a station comprising a backing roll 156 and a pin drum 158. The pins projecting from the cylindrical surface of the drum 158 penetrate the laminated sheet material as best indicated in FIG. 13 to develop a structure like that shown and described in conjunction with FIGS. 7 and 7A. The pin drum 158 is mounted in a support member 160 which is coupled to a control element 162 for appropriately positioning the member 160 and assuring that the pins of the pin drum 158 are applied to penetrate the sheet material 152 against the resilient surface of the backing roller 156. A cutting blade 164 and associated control station 166 are provided downstream to cut the continuous linear sheet material into appropriate lengths.

Figure 11:
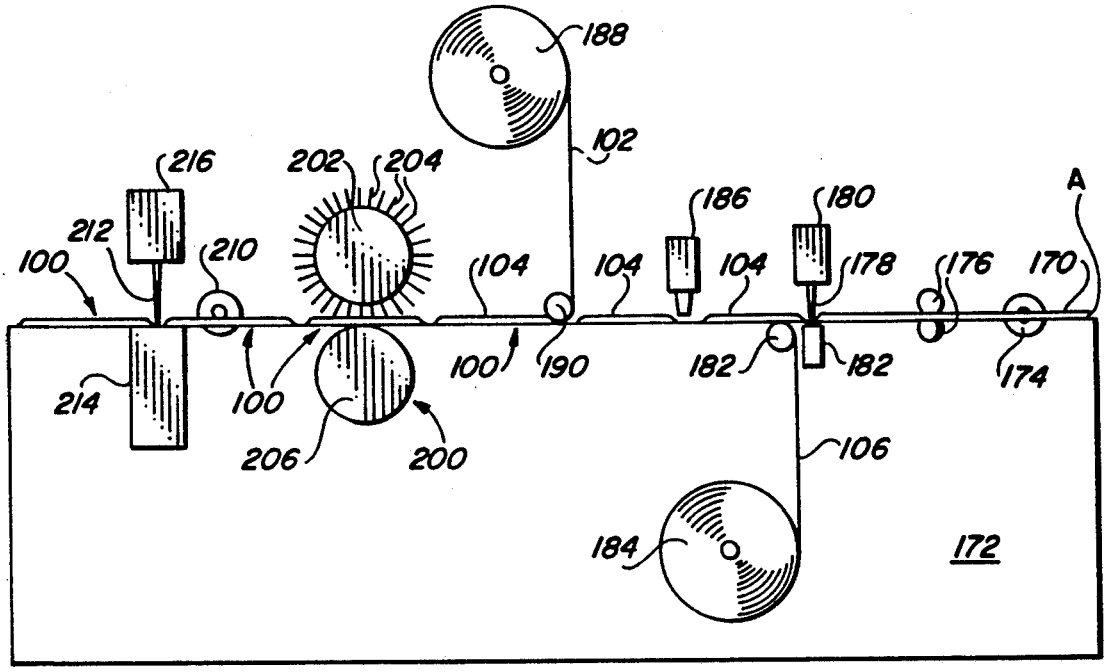
FIG. 11 is a schematic representation of a method of fabricating individual absorbent pads in accordance with the present invention.

FIG. 11 is a schematic representation of similar production line equipment for producing absorbent pads like the pad 100 of FIG. 6. The apparatus of FIG. 11 would be connected to the tissue layer gathering system of FIG. 10 at the point A in FIG. 10 in place of the apparatus which is to the left of point A. It will be understood, therefore, that the material 170 of FIG. 11 is in the form of a plurality of laminated tissue layers 108 which has been gathered and assembled by the apparatus in FIG. 10 to the right of point A. This is mounted on a conveyor table 172 which transports the material 170 and supports the various elements of apparatus shown in FIG. 11 to finish the material 170 into individual pads 100. At the next station along the conveyor table 172 is a plurality of slitting wheels 174 which serve to slit the tissue laminations 170 into a series of longitudinal strips of the width desired for the individual pads. Rollers 176 serve to separate the strips of tissue laminations to develop the desired spacing between them for the application of the upper and lower plastic sheets. The laminated tissue mats are cut transversely by a cutter blade 178 at a cutting station 180, the blade bearing against a backing member 182.

Following the cutting of the laminated tissue layers 170 into individual tissue mats by the slitting wheels 174 and the transverse cutting blade 178, the mats 104 are spaced from each other lengthwise at the support roller 182 where the bottom sheet of plastic material 106 is introduced from a supply roller 184. The sheet material 106 then moves along the conveyor table 172 of the associated mats 104. Adhesive is applied at a glue station 186, being sprayed only onto the areas of the bottom sheet 106 around the periphery of the individual tissue mats 104.

At the next station, the upper sheet 102 is fed from a supply roll 188 and pressed against the bottom sheet 106 and tissue mat 104 by an application roller 190. This serves to seal the two sheets 102 and 106 together about the periphery of each of the individual tissue mats 104.

Following the application roller 190, the production line structure comprises a plurality of individual absorbent pads 100, each having an individual tissue mat 104 sandwiched between upper and lower sheets 102, 106, the structure still being held together by the continuous sheets 102, 106.

The next step is the perforating of the pads 100 at perforating station 200 at which a pin drum 202 having a plurality of pins 204 projecting from the surface thereof in a selected pattern is indicated. The pattern may be random or regularly spaced as desired. As the pads 100 pass between the pin drum 202 and a backing drum 206, similar to what is shown in FIG. 13, the pins 202 penetrate the pads 100 to provide the perforated structure shown in FIG. 7. The backing roller 206 preferably has a resilient surface about its circumference to accommodate full penetration of the pins. The perforated pads then pass along another series of slitting wheels 210 which slit the side edges of the upper and lower plastic sheets 102, 106, after which the pads are fed to a transverse cutting blade 212 which is periodically dropped against a backing member 214 by blade control stage 216 which completes the separation of the longitudinal edges of the pads 104 except at spaced tacking points which permit the pads to be handled in quantity for packing, a layer at a time, to be ultimately separated by the end user. At the very left-hand end of the conveyor table 102, the pads are in finished form, perforated and ready for packaging and shipment.

Figure 12:
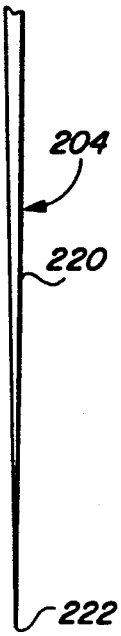
FIG. 12 is an enlarged view of one of the perforating pins used in FIGS. 10 and 11.

The individual pins 204 of the pin drum 202 have a preferred size and shape as shown in FIG. 12, although variants may be used. As indicated in the schematic drawing of FIG. 12, the pin 204 is slightly tapered along its shank 220 from about 0.040 inch diameter at the pin drum to a pointed end or tip 222. In one preferred embodiment, the pins 204 of the pin drum 202 project approximately 3/16 inches from the surface of the drum 202 which is 4 inches in diameter. The pin drum 202 and the backing drum 206 are displaced from each other by a distance proportional to the thickness of the sheet material. The pads 100 which are fabricated by the arrangement of FIG. 11 vary in thickness depending on the number of tissue layers assembled in the laminated mat. A typical thickness is approximately 0.20 inches in the uncompressed configuration. The pins 204 are spaced on the surface of the perforating drum 202 approximately ⅛ inch apart, both longitudinally and transversely.

Thus the density of the perforations in the pad 100 is approximately 64 perforations per square inch. This has been found to be extremely effective in providing absorbent pads in accordance with the present invention for use with wrapped meat, fish and poultry products when prepared for sale in the retail trade.

Although there have been described hereinabove various specific arrangements of a perforated absorbent pad and method of fabrication in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An absorbent product for absorbing liquids bleeding from food items derived from animals comprising:

a core including a mat of absorbent material;

an upper sheet and a lower sheet situated on opposite sides of said mat, said sheets having opposite edges which are sealed together to define an envelope encasing said core;

said product being perforated throughout with a plurality of perforations extending through both of said sheets and said mat, said perforations forming inwardly directed openings in said upper sheet, outwardly directed openings in said lower sheet, and channels extending through said mat, wherein each perforation comprises one of said inwardly directed openings, one of said outwardly directed openings, and one of said channels, wherein said openings and said channel of each perforation are collinear; and means for drawing liquid into said core from the exterior of said product through the outwardly directed openings in said lower sheet.

2. The product of claim 1 wherein said liquid drawing means comprises a plurality of tufts of said absorbent material extending from said mat through the openings in said lower sheet and projecting outwardly beyond the outer surface of said lower sheet to form a plurality of wicks for drawing liquid into said core from the exterior of said product.

3. The product of claim 2 wherein said mat comprises a plurality of individual layers of cellulose tissue laminated together to form said mat.

4. The product of claim 3 wherein said mat further comprises a plurality of superabsorbent particles interspersed with said tissue layers.

5. The product of claim 3 wherein the perforations through said mat define circumferential edges in each of said tissue layers which enhance the absorbency of said layers.

6. The product of claim 2 wherein each of said upper and lower sheets comprises a thin layer of generally impermeable material.

7. The product of claim 5 wherein the material of at least one of said sheets comprises plastic.

8. The product of claim 7 wherein both of said sheets are formed of plastic material.

9. The product of claim 8 wherein said plastic material is polyethylene.

10. The product of claim 7 wherein said lower sheet comprises a layer of wet-strength tissue material.

11. The product of claim 1 wherein said means for drawing liquid into said core comprise tufts of said absorbent material lodged in the outwardly directed openings of said lower sheet to prevent said openings from closing under normal compressive forces applied to said product in use.

12. The product of claim 1 fabricated to form an individual pad for placing under a food item when packaged for sale, said pad having both end edges and side edges sealed together and defining said envelope encasing said core.

13. The product of claim 12 further comprising a tray and wrapping for encasing a food item, the pad being sized to correspond generally to the size of the bottom of said tray and positioned along said bottom between the food item and the tray bottom.

14. The product of claim 2 further including indicating means for designating the preferred orientation of said product relative to its placement in association with a food item.

15. The product of claim 14 wherein said indicating means comprise graphic indicia for distinguishing between the upper sheet and the lower sheet.

16. The product of claim 15 wherein said graphic indicia is positioned on the upper sheet and indicates that the printed sheet is to be oriented upwardly in use.

17. The product of claim 15 wherein the graphic indicia is printed on the lower sheet and indicates that the printed sheet should be oriented downwardly in use.

18. An absorbent product for absorbing liquids bleeding from food items derived from animals comprising:

a core including a mat of absorbent material;

an upper sheet and a lower sheet situated on opposite sides of said mat, said sheets having opposite edges which are sealed together to define an envelope encasing said core;

said product being perforated throughout with a plurality of perforations extending through both of said sheets and said mat, said perforations forming inwardly directed openings in said upper sheet, outwardly directed openings in said lower sheet, and channels extending through said mat, wherein each perforation comprises one of said inwardly directed openings, one of said outwardly directed openings, and one of said channels, wherein said openings and said channel of each perforation are collinear; and means for maintaining said outwardly directed openings in a flared configuration to enhance the flow of liquid from outside the product to the mat through the openings in the lower sheet.

19. The product of claim 18 wherein said means for maintaining said openings in a flared configuration comprise portions of material extending from the mat through said openings.

20. The product of claim 19 wherein said portions are in the form of tufts of absorbent material extending from the mat through the openings in the lower sheet and projecting outwardly beyond the outer surface of said lower sheet to form a plurality of wicks for drawing liquid into said core from the exterior of said product.

* * * * *